US006932618B1

(12) United States Patent
Nelson

(10) Patent No.: US 6,932,618 B1
(45) Date of Patent: Aug. 23, 2005

(54) MEZZANINE INTEGRATED CIRCUIT INTERCONNECT

(75) Inventor: Michael D. Nelson, Mountain View, CA (US)

(73) Assignee: Xilinx, Inc., San Jose, CA (US)

( * ) Notice: Subject to any disclaimer, the term of this patent is extended or adjusted under 35 U.S.C. 154(b) by 130 days.

(21) Appl. No.: 10/437,520

(22) Filed: May 14, 2003

(51) Int. Cl.[7] ..... H01R 9/09
(52) U.S. Cl. ..... 439/66; 439/91
(58) Field of Search ..... 439/66, 74, 91

(56) References Cited

U.S. PATENT DOCUMENTS

| | | | | | |
|---|---|---|---|---|---|
| 5,013,249 | A | * | 5/1991 | Lindeman et al. | 439/66 |
| 6,027,345 | A | * | 2/2000 | McHugh et al. | 439/66 |
| 6,168,442 | B1 | * | 1/2001 | Naoi | 439/91 |
| 2001/0049207 | A1 | * | 12/2001 | Sakata et al. | 439/66 |

* cited by examiner

*Primary Examiner*—Renee Luebke
(74) *Attorney, Agent, or Firm*—Walter D. Fields; Edel M. Young; Justin Liu

(57) ABSTRACT

An interconnect assembly to electrically interconnect one or more integrated circuits to an electronic device may comprise a base package to couple to a circuit board of the electronic device. A terminal mezzanine package may support the integrated circuit(s) above the base package. A first set of conductors of a first material and design carry low-frequency signals between the base and terminal connector packages. A second set of conductors of a second material and design carry high-frequency signals. In particular embodiments the base package may comprise a base mezzanine integrating one or more additional integrated circuits and intermediate mezzanines supporting one or more additional integrated circuits each and enabling multi-story modular interconnection structures. In particular embodiments, the second set of conductors may comprise columns of compressible polymer compound embedded with metallized particles, and the columns may be dispersed amongst pins and sockets of a pin-grid array.

61 Claims, 15 Drawing Sheets

MEZZANINE INTEGRATED CIRCUIT INTERCONNECT

FIELD OF THE INVENTION

The present disclosure relates generally to electronic devices constructed using integrated circuits, and more particularly to a mezzanine integrated circuit interconnect.

BACKGROUND

In constructing electronic devices using integrated circuits, flexibility in connecting integrated circuits to other portions of an electronic device may be useful in designing, prototyping, upgrading and repairing such devices. For instance, during initial design or prototype builds, a designer may wish to exchange an integrated circuit with others. This may be more easily facilitated using a plug-in interconnect than a soldered interconnect. Similarly, after manufacture or purchase of a circuit board or electronic device, a plug-in interconnect may allow economical upgrade or repair.

A pin grid array (PGA) interconnect is a known plug-in interconnect, which may be used for attaching integrated circuits to printed circuit boards. PGA pin and socket solutions are typically limited to low-frequency interconnections, which may also include power and ground connections. The low-frequency signal limitation may stem from an inconsistency of transmission length associated with the pins seated in the sockets, and also from stubs that may result from the attachment of the pins and sockets to their respective substrates. At higher frequencies, including the giga-hertz range, the PGA pin-sockets may show length inconsistencies and the stubs at their substrate attachments may act as small antennas, emitting electrical interference or "noise", often referred to as electromagnetic interference (EMI) or radio frequency interference (RFI).

Land grid array (LGA) systems may overcome some of the above limitations with use of alternative interconnect configurations. Landing pads may be formed on opposite facing surfaces of separate substrates, and a polymer compound material that is embedded with metallized particles may be configured in columnar structures and compressed for conductivity between the opposing landing pads. Accordingly, the metallized particle interconnects (MPI) with landing pads may avoid the stub and length variance difficulties of the pin/socket substrate assemblies.

In the MPI system, elastic polymer material with embedded metallized particles may be formed into small columns that may conduct as an interconnection when compressed. The columns may be supported in an insulating material such as polyimide. The polyimide with the MPI columns may then be sandwiched between first and second substrates—e.g., such as a first substrate to interface a circuit board and a second substrate over the first to seat an integrated circuit(s). These assemblies are typically held together between a base plate under the printed circuit board and a heat sink over the integrated circuit(s).

To achieve a desired electrical conductivity, the MPI columns must typically be compressed and may require a compression force of tens of grams per column. With a large array of MPI columns, a collective compressive force on the order of 50 or 60 pounds might be required.

SUMMARY

In accordance with an embodiment of the present invention, a mezzanine integrated circuit interconnect may comprise a first connector package to couple to an electronic device and a second connector package disposed over the first connector package to seat an integrated circuit. The interconnect may further comprise an array of first conductors of a first material disposed between the first connector package and the second connector package to carry low-frequency signals therebetween. Second conductors of a second material different from the first may be disposed between the first connector package and the second connector package to carry high-frequency signals.

In a further embodiment, the first conductors may comprise sockets lined with metal within the first connector package and pins of the second connector package seated within the sockets. The second conductors may comprise columns of compressible conductive material between the fist and second packages. The columns may comprise an elastic polymer compound embedded with metallized particles.

In accordance with a further embodiment, a plug of insulating material may support at least one column of the compressible material. The plug may be disposed within a receptacle of the first connector package to position the column of elastic material coaxially within the receptacle and to contact the ends of the column(s) with respective LGA pads of the respective first and second connector packages.

In a further embodiment, the plug may support two columns of the compressible material as a pair coaxially positioned within the receptacle. The pair may comprise a characteristic impedance to match the impedances to and through launches of the column ends to respective first and second connector packages.

In a further embodiment, the pins in the sockets define at least in part an array of the first conductors. The plug may be disposed in the receptacle and amongst the array and may orient the compressible columns in substantially parallel relationship to the neighboring pins/sockets.

In a further embodiment, a central region of the first connector package defines a floor, and a corresponding central region of the second connector package is disposed opposite the floor to define a ceiling. The first and second connector packages may be coupled together to define at least in part a cavity between the floor and ceiling. A second integrated circuit may be coupled to the floor and conductors of the first connector package may electrically couple the terminals of the second integrated circuit to the first and second conductors. In yet a further embodiment, a third integrated circuit may be coupled to the ceiling and conductors of the second connector package may electrically couple terminals of the third integrated circuit to the first and second conductors.

DESCRIPTION OF EMBODIMENTS

Figure 1:
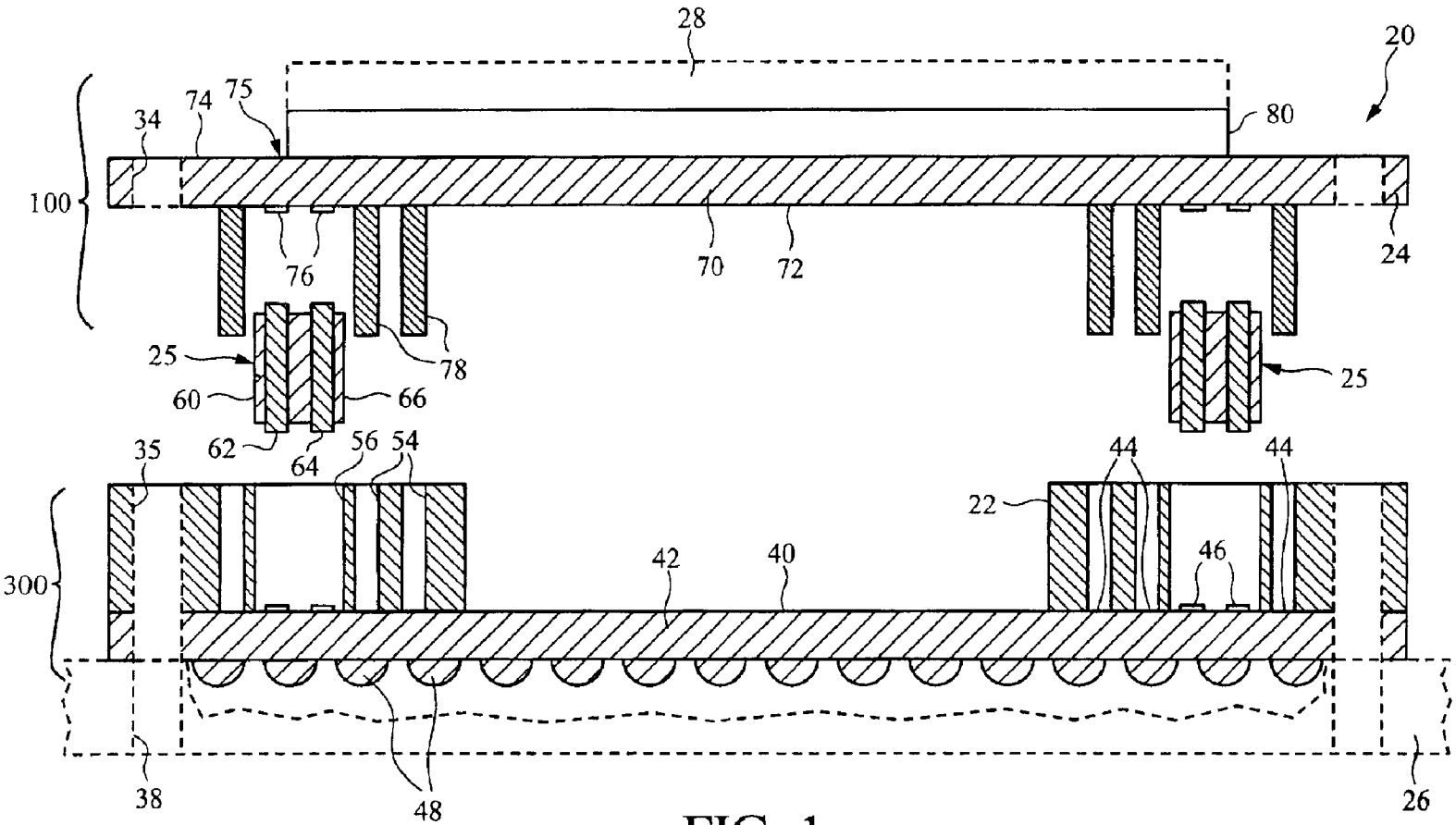
FIG. 1 is a simplified exploded sectional view of a mezzanine integrated circuit interconnect in accordance with an embodiment of the present invention.

In the following detailed description, reference may be made to the accompanying drawings, which form a part hereof, and in which are shown, by way of illustration, specific embodiments for practicing the invention. In the drawings, certain elements may not necessarily be drawn to scale. Additionally, like or similar elements may be designated by the same item number through the separate views.

Furthermore, readily established circuits or elements of the exemplary embodiments may be disclosed in simplified form (e.g., block diagram style) to avoid obscuring an essence of the embodiments with excess detail. Likewise, to aid in a clear and precise disclosure, the description of their operations (e.g., timing considerations and the like) may similarly be simplified when persons of ordinary skill in this art can readily understand their operations by way of the drawings and disclosure.

The terms carrier and substrate within the present description may reference any structure having an exposed surface with which to form a circuit or an integrated circuit (IC or "chip"). In forming the substrate, one or more patterned layers may result in topographies of various heights. Further, the substrate may comprise a patterned dielectric over an insulating layer or a conductive layer (e.g., ground plane). It may also reference supporting layers, or portions of, e.g., a semiconductor structure, ceramic or circuit board such as PCB.

The term "conductor" may be understood to reference metals, semiconductors, and other electrically conductive materials. "Insulator" may reference material that is less electrically conductive than the materials referred to as conductors.

Those skilled in the present art may be familiar with a variety of acronyms. For example, as used herein, a few of these may be defined as follows:

ASIC=Application Specific Integrated Circuit
BGA=Ball Grid Array
CPU=Central Processing Unit
CSM=Chip Scale Mezzanine
DRAM=Dynamic Random Access Memory
FPGA=Field Programmable Gate Array
IC=Integrated Circuit or a "chip"
I/O=Input/Output
LGA=Land Grid Array
MGT=Multi-Gigabit Transceiver
MPI=Metallized Particle Interconnect
PCB=Printed Circuit Board
PGA=Pin Grid Array
RAM=Random Access Memory
ROM=Read-Only Memory It may be noted that a field programmable gate array (FPGA) is a specialized application of a programmable gate array, which has an acronym of "PGA". Within this disclosure, however, "PGA" shall reference pin grid array. Thus, to avoid confusion, the acronym "FPGA" as used herein may be understood to reference both field programmable gate arrays and the more generic programmable gate arrays.

Figure 2:
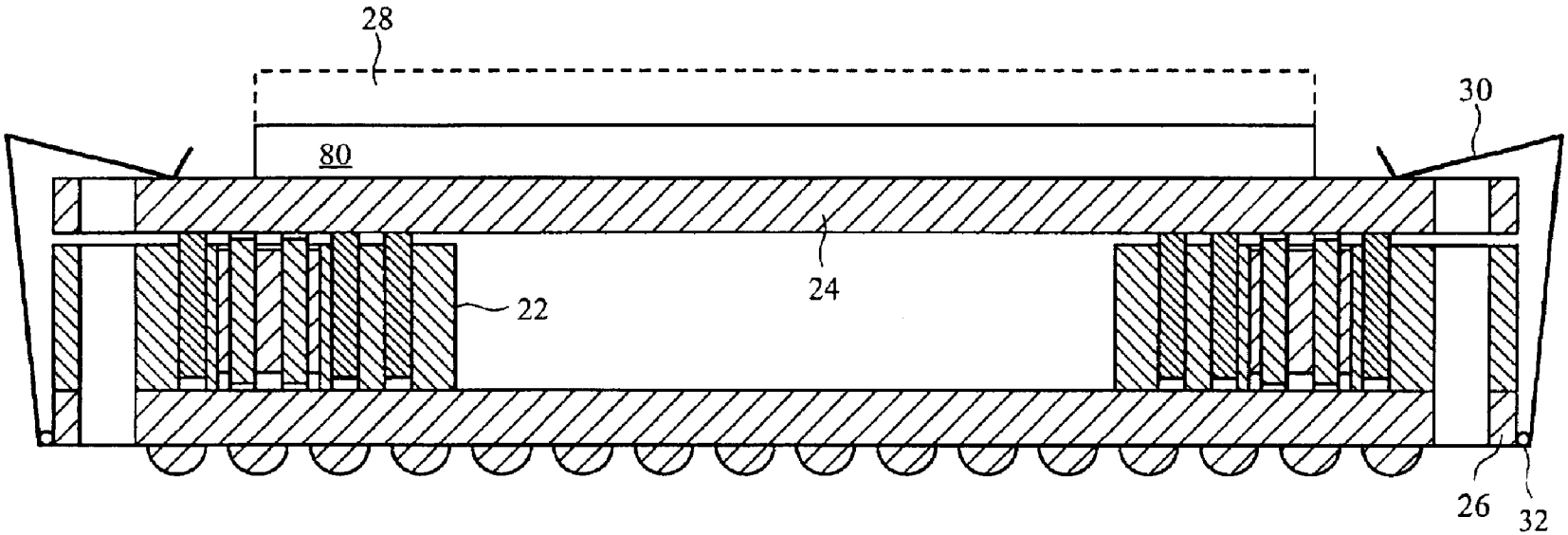
FIG. 2 is a sectional view of an embodiment of FIG. 1 assembled.
Figure 3:
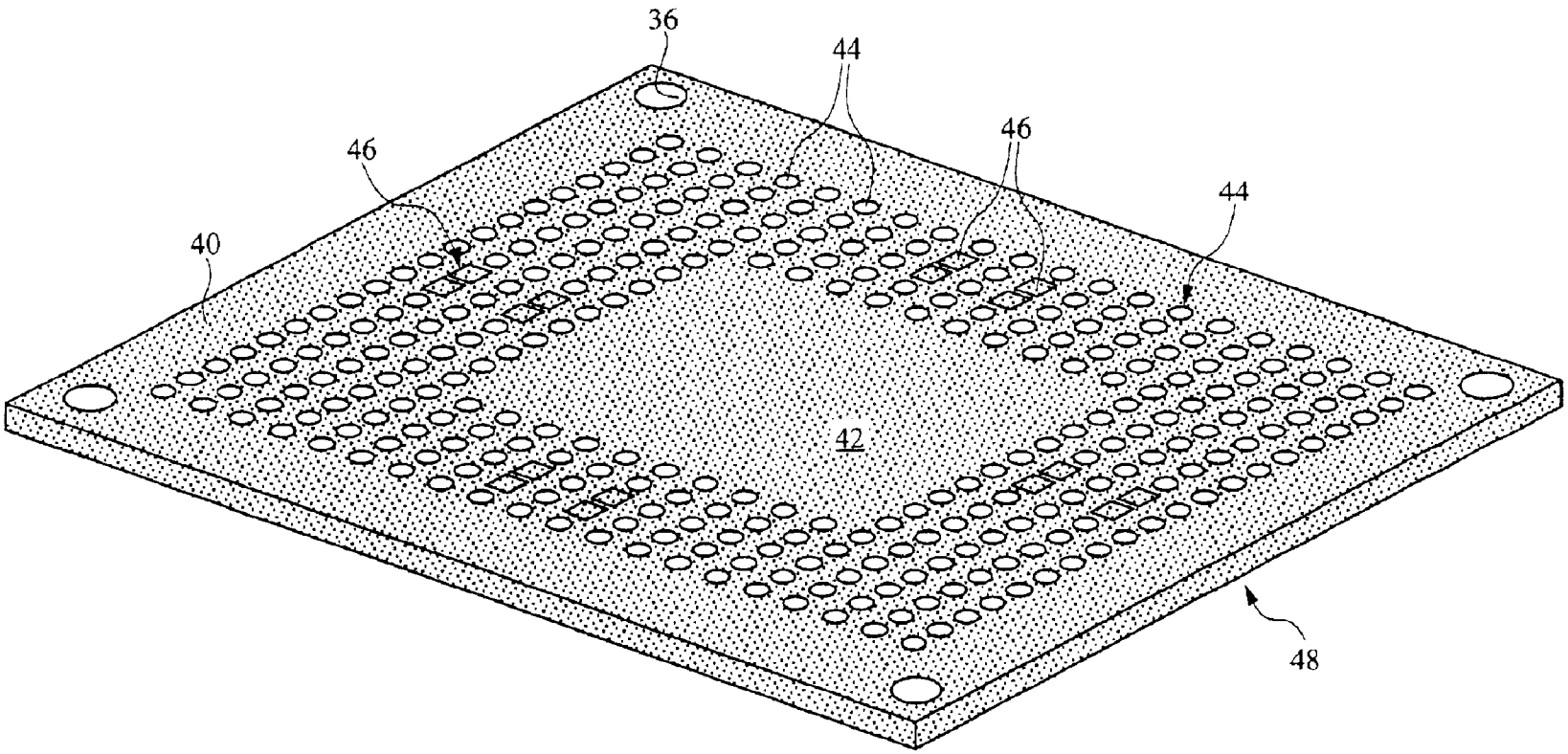
FIG. 3 is a perspective view of a base carrier that may be used for an embodiment of the present invention.

FIGS. 1 and 2 illustrate a first embodiment of a mezzanine integrated circuit (IC) interconnect 20. FIG. 1 shows the various components disengaged, while FIG. 2 shows them assembled. Interconnect system 20 may comprise package 22, mezzanine package 24 and signal plug 25, which together may interface base substrate 26, such as a printed circuit board (PCB) portion of an electronic device. The interconnect may allow communication between base substrate 26 and IC product 28.

For purposes of simplifying the understanding of certain concepts described herein, socket and mezzanine packages 22 and 24, as well as base carrier 26 may be referenced along a horizontal plane. It is apparent, however, that the illustrated interconnect system 20 may operate in any orientation.

Further referencing FIG. 2, socket package 22 may be clamped to mezzanine package 24 to sandwich one or more signal plugs 25 therebetween. A securing mechanism, such as clamps 30, may hold them together. In the illustrated embodiments, clamp 30 may comprise a spring-loaded device, attached by hinge members 32 to socket package 22.

Alternatively, a screw or bolt-and-nut assembly, or a post-and-retainer assembly such as a snap-fit member, or other fastening mechanisms known to those skilled in the art may be used to hold the pieces together. In one such example, a bolt may pass through a series of holes of the substrate and packages. Hole 34 may be defined by a portion of mezzanine package 24, holes 35 and 36 defined by two portions of socket package 22, and hole 38 defined by a portion of base substrate 26.

The mezzanine integrated circuit interconnect 20, in accordance with embodiments of the present invention, may be used to interface IC product 28 to base substrate 26 of e.g., an electronic device. Exemplary IC products 28 may comprise one or more of the group consisting of central processing units (CPU), read-only memory (ROM), random access memory (RAM), flash memory, application specific integrated circuits (ASICs), digital signal processors (DSPs), security processors, field programmable gate array (FPGA) logic, optical interfacing devices, array optics, silicon optical bench units, Ethernet components, ultra fast electronics, radio frequency (RF) components, Micro- Electro Mechanical Systems (MEMS), chemical laboratory transducers, biochips, etc. Thus, interconnect system 20 may be highly attractive in many scientific, medical (e.g. modular chip level biotechnological test labs in doctors' offices), industrial, wireless base station (e.g. RF module integration), and telecommunication (optical module integration, line card I/O configuration, etc.) implementations where modularity and good signal integrity may be beneficial.

Referencing FIGS. 3–6, a socket package (22 of FIGS. 1–2) may comprise base unit 40 with central portion 42. In certain embodiments, this substrate may comprise a printed circuit board. Surrounding central portion 42, a series or array of solder pads 44 may be disposed to interface pins of a pin grid array. Additionally, the base carrier may further comprise land grid array (LGA) pads 46. In this example, the LGA pads are illustrated as rectangular or square shaped pads interspersed amongst round-shaped PGA pads 44. It is understood that other configurations may comprise alternative shapes for these pads.

In the illustrated embodiments, a plurality of paired LGA pads 46 are shown on the base carrier. For example, eight pairs of LGA pads may be provided. Additionally, pads 44,46 have been shown as an array defining a rectangular frame around the central portion. It will be understood, however, that the array of pads could also define alternative shapes around central potion 42—i.e., such as a U-shape or an L-shape—or it may encompass the entire area of base unit 40.

Finally, as further shown in FIGS. 1 and 2, base carrier 40 may have an undersurface upon which a series of protruding interface contacts may be disposed. For example, mounting balls of a ball grid array 48 may be formed on the undersurface. Conductors of, or within, the base carrier may electrically couple the underside contacts to respective pads of the PGA and LGA pads 44,46.

Figure 4:
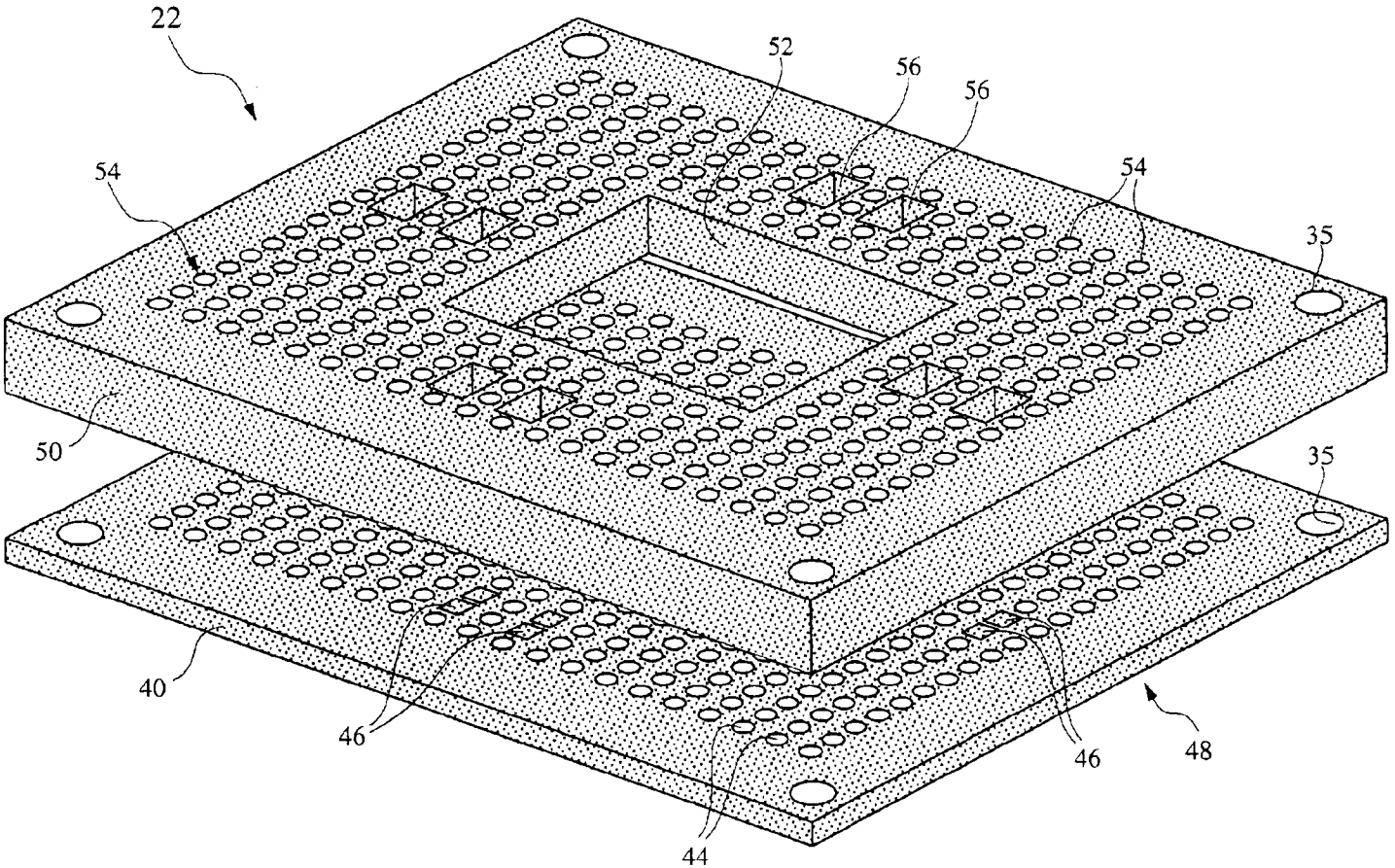
FIG. 4 is an exploded perspective view of a base carrier portion and a body portion for an embodiment of the present invention.

Referencing FIG. 4, another section of socket package 22 may comprise a body portion 50 disposed over base carrier 40. Body 50 may comprise walls 52 that define a window to access central portion 42 of base carrier 40.

Body 50 may also define an array of PGA pin sockets 54. Each socket 54 may comprise metal lined holes in the body aligned with respective PGA pads 44 of base carrier 40. Body 50 may also comprise cavities 56 to define a plurality of receptacle openings to access pairs of LGA pads 46.

Figure 5:
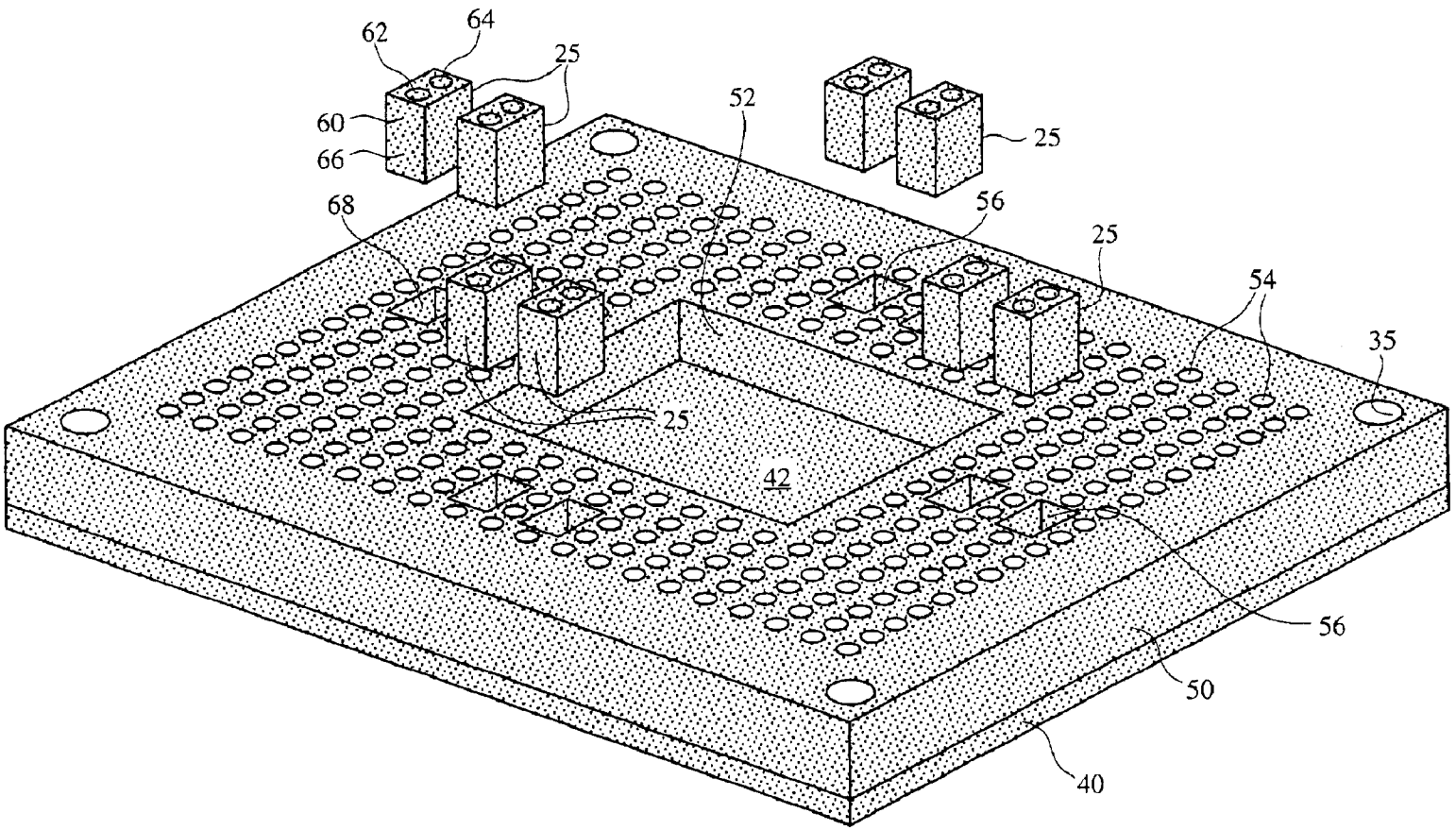
FIG. 5 is an exploded perspective view of a body portion and plug assembly for a further embodiment.

In FIG. 5, body 50 is joined with base carrier 40. Signal plugs 25 are shown associated with corresponding receptacles 56. In accordance with one embodiment, the plugs 25 may be secured within receptacles 56 using an adhesive material of elastic properties, which may allow plugs 25 to float within the receptacles. In a further embodiment, the adhesive material may be electrically conductive.

Further referencing FIG. 5, plug 25 may comprise support body 60, which may support a pair of columnar, metallized particle interconnect (MPI) conductors 62,64 therein. In a particular embodiment, MPI conductors 62,64 extend beyond the ends of support body 60 (FIG. 1), and may comprise high temperature polymer compound embedded with metallized particles. When compressed under force, they will electrically conduct.

In a particular embodiment, support body 60 and receptacle 56 are sized for slip-fit relationship relative to each other (i.e., with a finite clearance therebetween). For example, the clearance may be on the order of about 0.0005 to 0.007 inches and, generally, about 0.005 inches. Support body 60 may comprise insulating material, such as polyimide. Known sources for such body support 60 with MPI conductors 62,64 include Tyco Electronics, Inc. of Harrisburg, Pa.

In the embodiment illustrated, plugs 25 may comprise two columnar MPI members 62,64. In alternative embodiments (not illustrated), the plugs may comprise another number of columnar MPI members.

Figure 15:
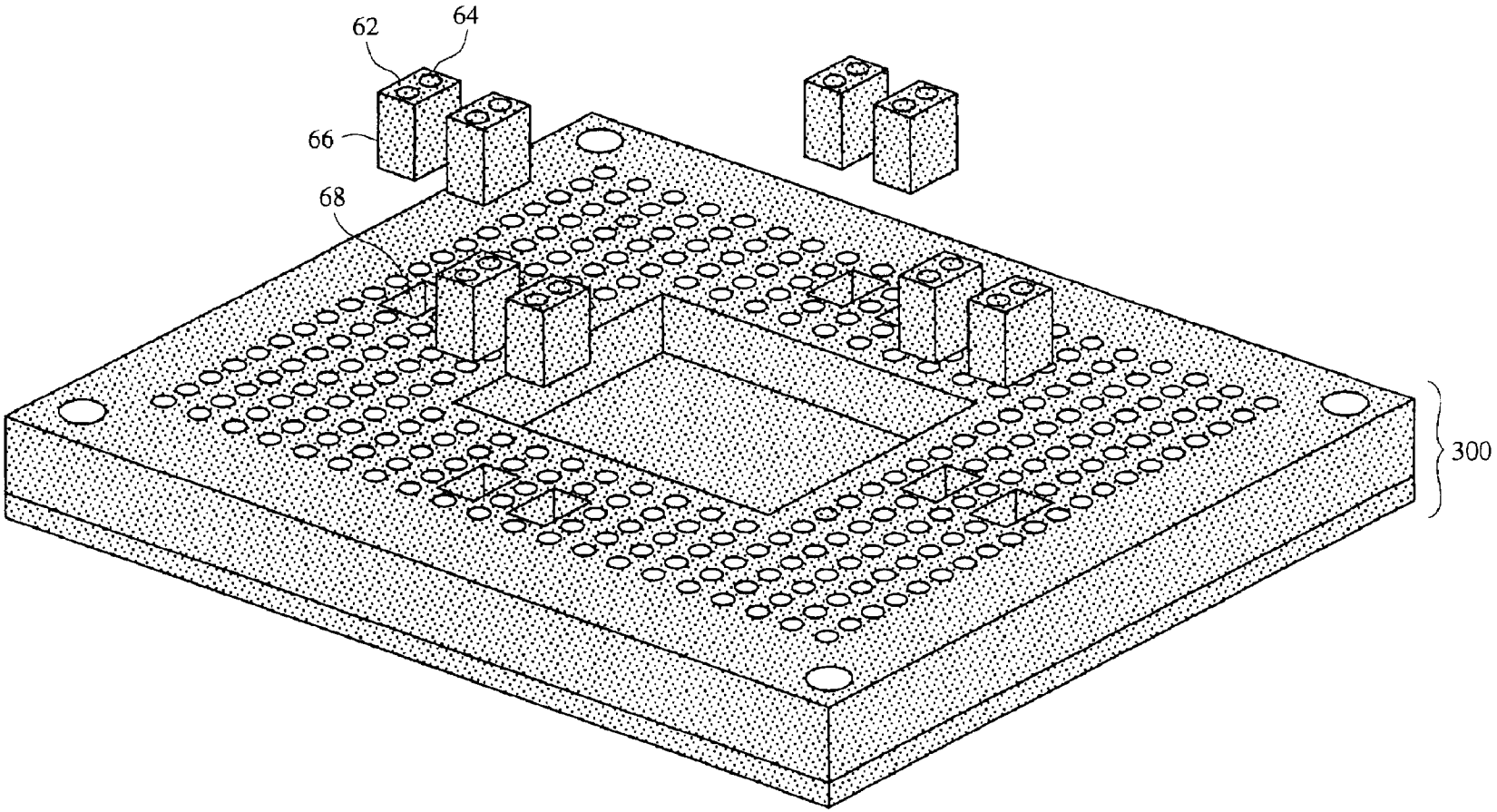
FIG. 15 is a perspective view of a base mezzanine with its carrier, body and metal lined receptacles together with metal plated plugs in accordance with further embodiments of the present invention.

In further embodiments, conductive material may be disposed around the outside walls of plug 25. For example, conductive coating 66 may be formed on the sidewalls (FIGS. 5 and 15) of support body 60 and coaxially around the pair of MPI columns.

Furthermore, a conductive lining 68 may also be formed on sidewalls 56 that define the receptacles. The conductive lining in one embodiment may be electrically coupled to ground. Adhesive material may be disposed between plugs 25 and walls 56 and electrically conductive to electrically couple the outer conductive coating 66 of plug 25 with conductive lining 68.

In particular applications, the conductive coatings may serve to define and preserve a characteristic impedance of the columnar members. Further, they may shield high frequency signals and reduce electrical "noise", often manifested as electromagnetic interference (EMI) or radio frequency interference (RFI).

Figure 6:
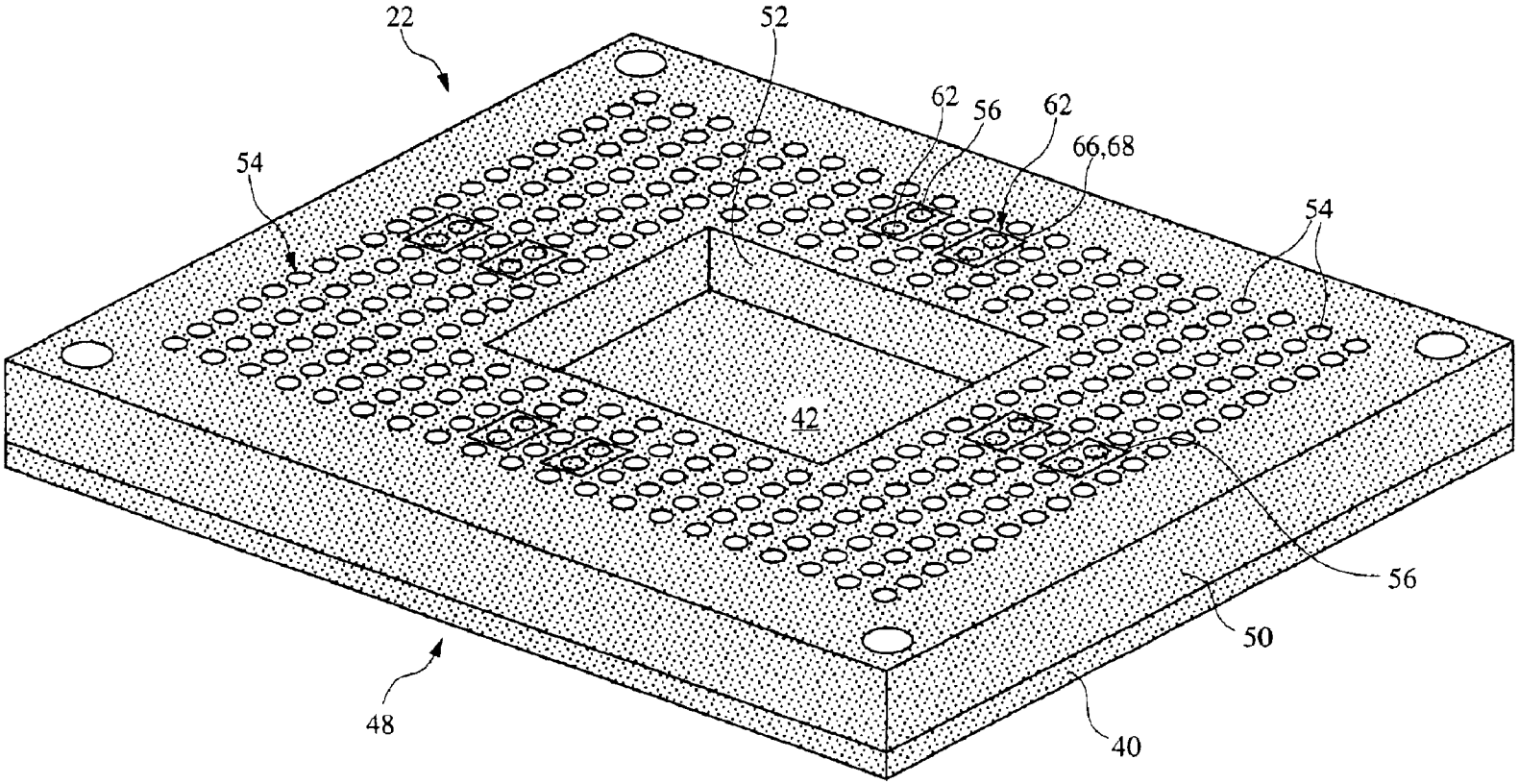
FIG. 6 is a perspective view of the components in FIG. 5 assembled.

Referencing FIG. 6, plugs 25 may be disposed within the receptacles. In one embodiment, the ends of the MPI members 62,64 may extend beyond the insulating material of the plugs and may be held in electrical contact with LGA pads 46 (FIGS. 1–2).

Referring back to FIGS. 1 and 2, mezzanine package 24 may comprise mezzanine carrier 70. In a particular embodiment, it may comprise ceramic or an FR-4 or other PCB material. Further referencing FIGS. 1–2, central region 72 of the mezzanine carrier substrate 70 may be disposed in a spatial relationship over the open central region 42 of socket base carrier 40. The mezzanine carrier substrate may further comprise upper surface 74, upon which may be formed various electrical traces. For example, in particular embodiments, the traces may be constructed using traditional printed circuit board manufacturing techniques.

Located along this undersurface of mezzanine carrier substrate 70 may be groups of land grid array (LGA) pads 76, which may be configured similarly as LGA pads 46 of base carrier 40. MPI members 62,64 of plugs 25 may contact respective LGA pads 76 of the mezzanine carrier substrate when the mezzanine carrier is secured to socket package 22.

A series or array of pin grid array (PGA) conductors (pins 78) may project outwardly from the underside of mezzanine carrier substrate 70. These pins 78 may be aligned to and inserted within PGA sockets 54 of socket package 22 (FIG. 2). Pins 78 and respective sockets 54 may be configured as known for zero insertion force (ZIF) design or for a press-fit socketing design. It should be noted that ZIF type sockets typically incorporate some form of pin-to-socket locking mechanism that is not illustrated.

Upper surface 74 of mezzanine carrier substrate 70 may support a known integrated circuit plug-in receptacle 80, which may seat and interface IC product 28. The plug-in receptacle 80 may electrically interface the IC product 28 with conductive traces 75, which in turn may electrically couple via interconnect system 20 to electronic device 26. The structure of plug-in receptacle 80 may be selected based upon the type of IC product 28.

Again, the columnar MPI members 62,64 will electrically conduct when compressed between LGA pads 46 of base carrier substrate 40 and LGA pads 76 of the mezzanine carrier substrate 70 (FIGS. 1–2). These dedicated high frequency conductors have been described for certain embodiments as comprising MPI material. It should be understood that other similarly operable conductive materials may be substituted therefore.

In a particular application, high-speed signals of, e.g., multi-giga-hertz-plus data rates may propagate along the MPI columnar conductors between mezzanine package 24 and socket package 22. Other signals, such as low frequency I/O signals, power and ground, and signals where noise may be of less concern, may be routed to propagate along PGA pins between the mezzanine package and the socket package.

Figure 7:
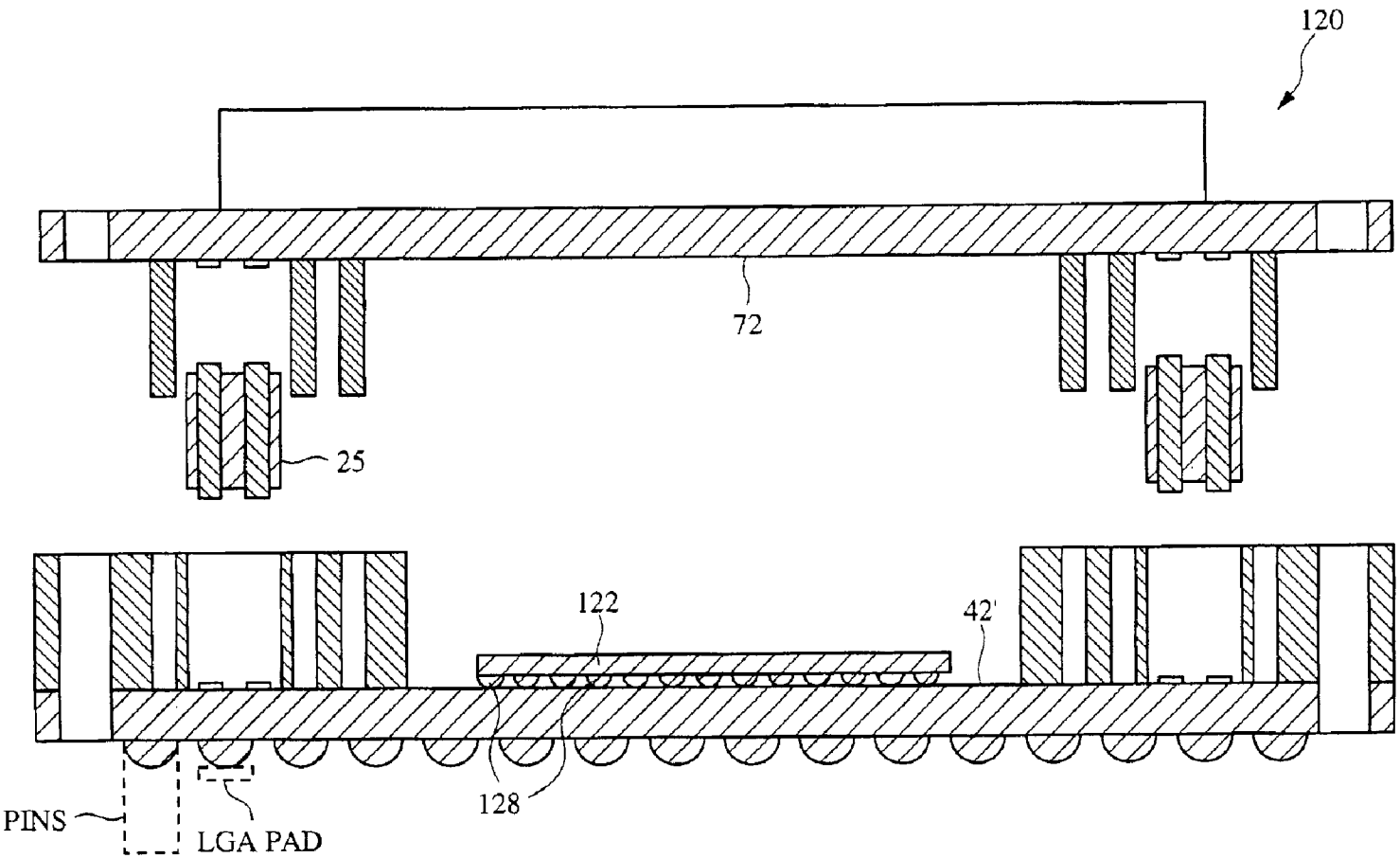
FIG. 7 is an exploded sectional view of a mezzanine integrated circuit interconnect for an embodiment of the present invention.
Figure 8:
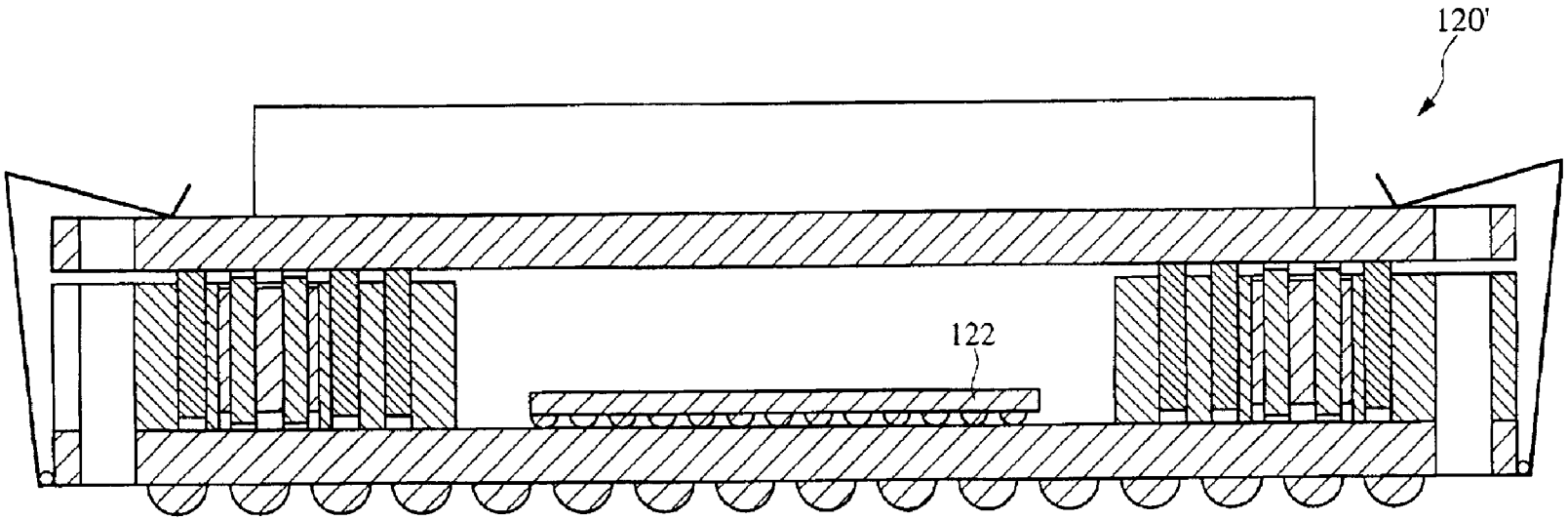
FIG. 8 is a sectional view for an embodiment of FIG. 7 assembled.
Figure 9:
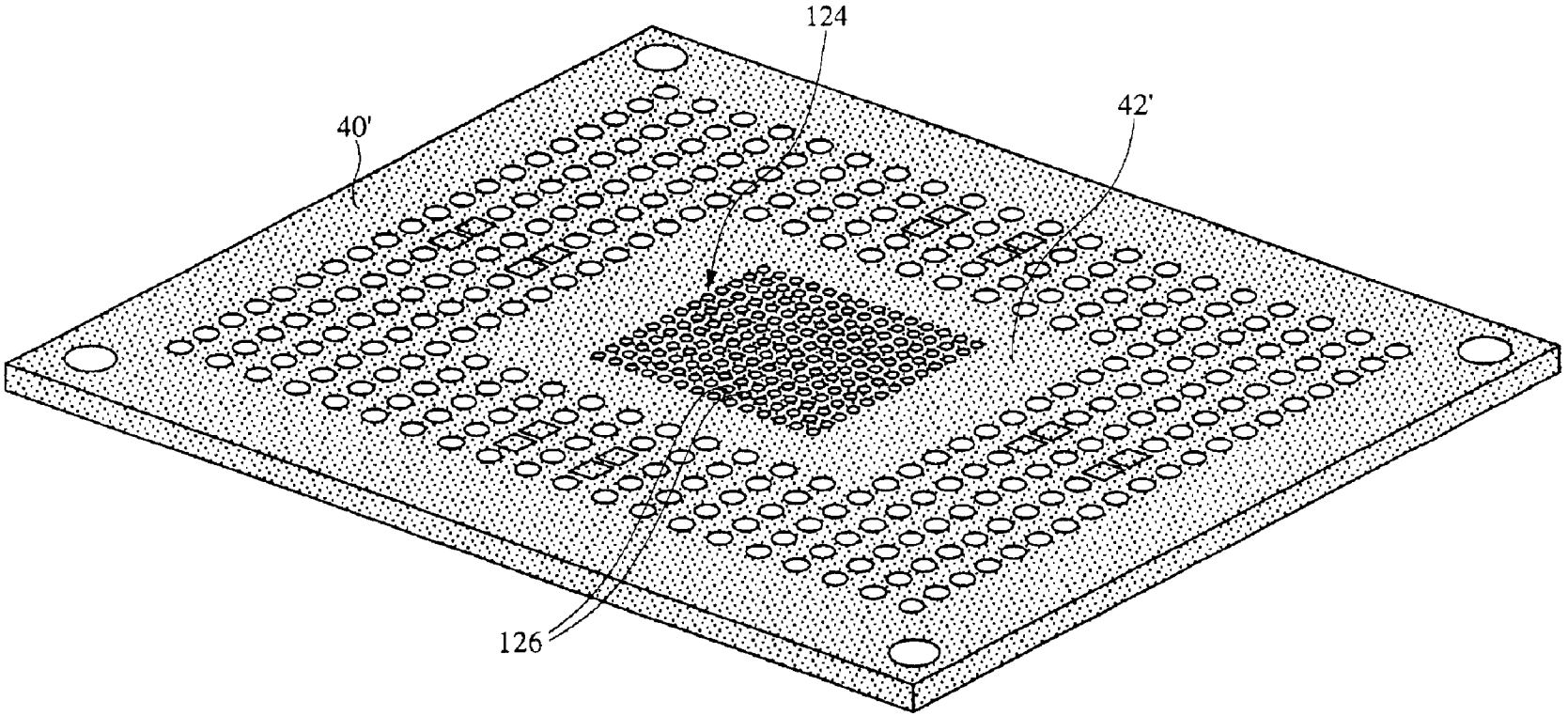
FIG. 9 is a perspective view of a base carrier useful for an embodiment of the present invention.

In a further embodiment, referencing FIGS. 7 through 10, a mezzanine IC interconnect or "chip scale mezzanine" (CSM) 120 may further comprise a flip-chip 122, which may be any type of integrated circuit or electronic component. As shown in FIG. 9, a modified base carrier 40' may comprise an array 124 of mounting pads over central region 42' to seat a flip-chip. The array may comprise a pattern of surface mount conductor pads 126, which may be coupled to BGA mounting balls 128 along an undersurface of flip-chip 122 (FIGS. 7 and 8).

Figure 10:
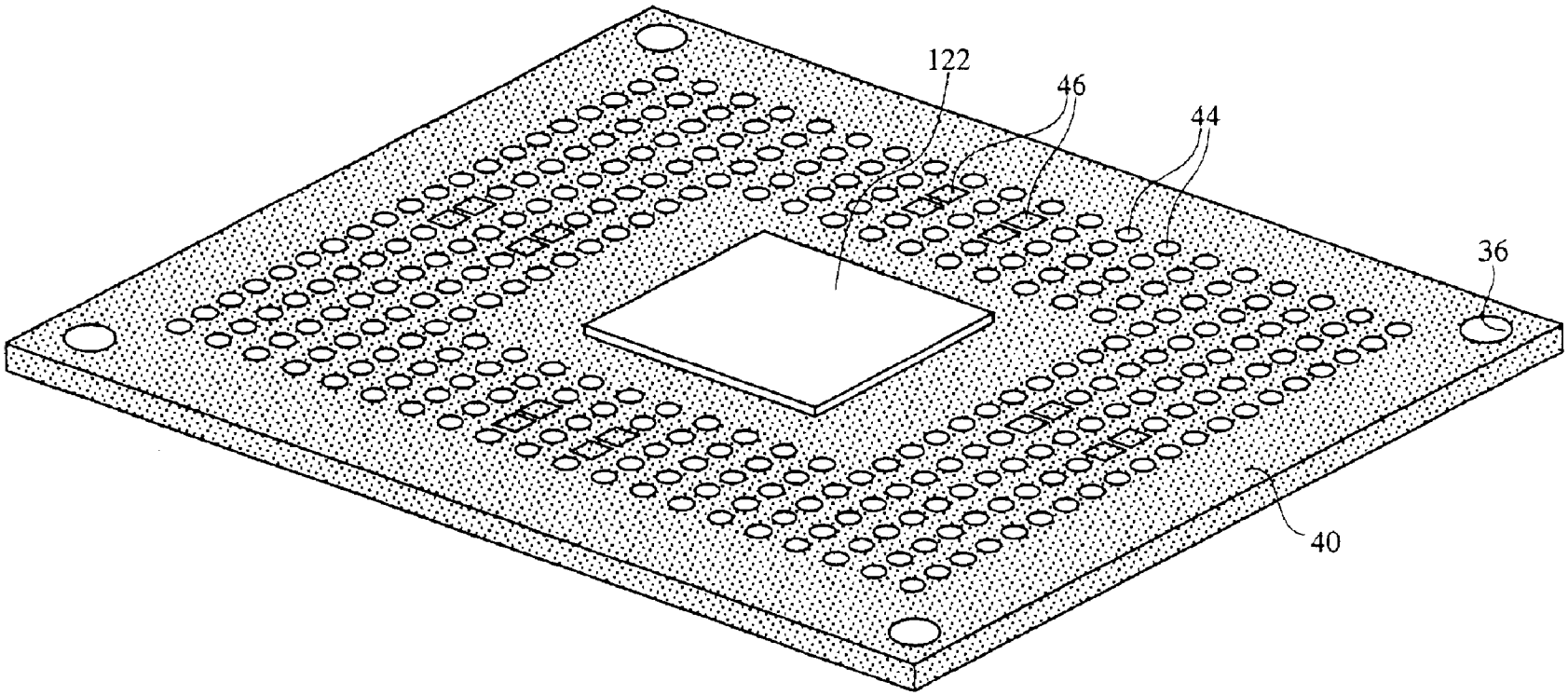
FIG. 10 is a perspective view of a base carrier and a flip-chip mounted thereon for a further embodiment.

FIG. 10 shows flip-chip 122 mounted to carrier substrate 40'. The mezzanine interconnect system 120 may be configured to allow flip-chip 122 to communicate either with IC product 28 installed on the mezzanine package 24, or other component(s) of the electronic device (via the device PCB 26 of FIG. 1), or both.

Figure 14A:
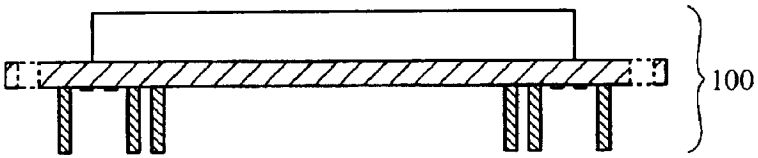
FIGS. 14A–14D are sectional views of exemplary upper, intermediate and base interconnect packages for embodiments of the present invention.
Figure 14B:
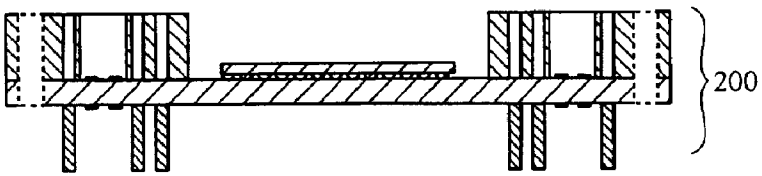
Figure 14C:
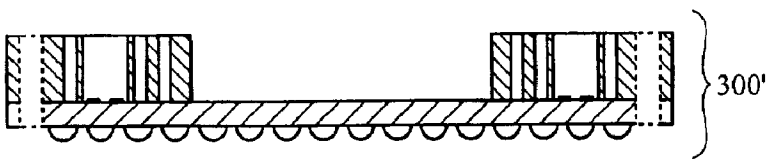
Figure 14D:
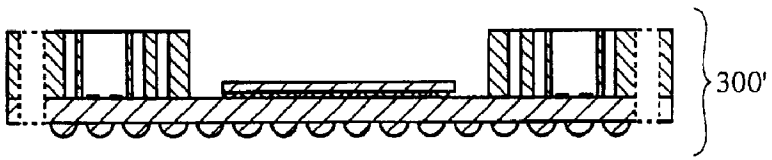

Skipping forward, with reference to FIGS. 13, 14A–14D, in accordance with further embodiments, an interconnect assembly 320 may comprise upper, intermediate and lower packages 100,200,300' respectively. These may be referenced alternatively as terminal mezzanine 100 (FIG. 14A), intermediate mezzanine 200 (FIG. 14B) and base mezzanine 300 or 300' (FIGS. 14C–14D). Each of the carriers of the different levels may be populated with semiconductor devices.

Conductors 78' may be fixed to an undersurface of substrate carrier 324 of intermediate mezzanine 200 to form, e.g., pins operable to be received in sockets of the body 22 of base mezzanine 300'. Further, body 22' of intermediate mezzanine 200 may also comprise sockets to receive pins 78 of terminal mezzanine 100. Plugs 25 may be disposed in receptacles of respective body 22',22 of the intermediate and base mezzanines. The plugs may align MPI column structures between the LGA pads of the different layers.

This multi-layered configuration may be described as a stacked or two-story interconnect system. Further embodiments may comprise several of the intermediate interconnect packages, which may be stacked together to produce a multi-tiered interconnect assembly.

For such embodiments, the ultimate height of the structure might be limited by the physical space as well as thermal and other design considerations. Use of such a multi-tiered interconnect system may allow system designers to more densely pack electrical components while consuming a nominal amount of surface space over device substrate 26 such as a PCB.

Turning back to reference FIG. 11, in accordance with another embodiment, interconnect assembly 220 may comprise terminal mezzanine package 100' with substrate 24'. This substrate 24', may comprise undersurface 224 configured to carry integrated circuit 225 or other electrical component(s). Electrical traces 226 of the undersurface 224 may electrically interface integrated circuit 225, which in-turn may communicate with IC product 28, flip-chip 222, and/or devices of PCB 26 (FIG. 1).

Figure 11:
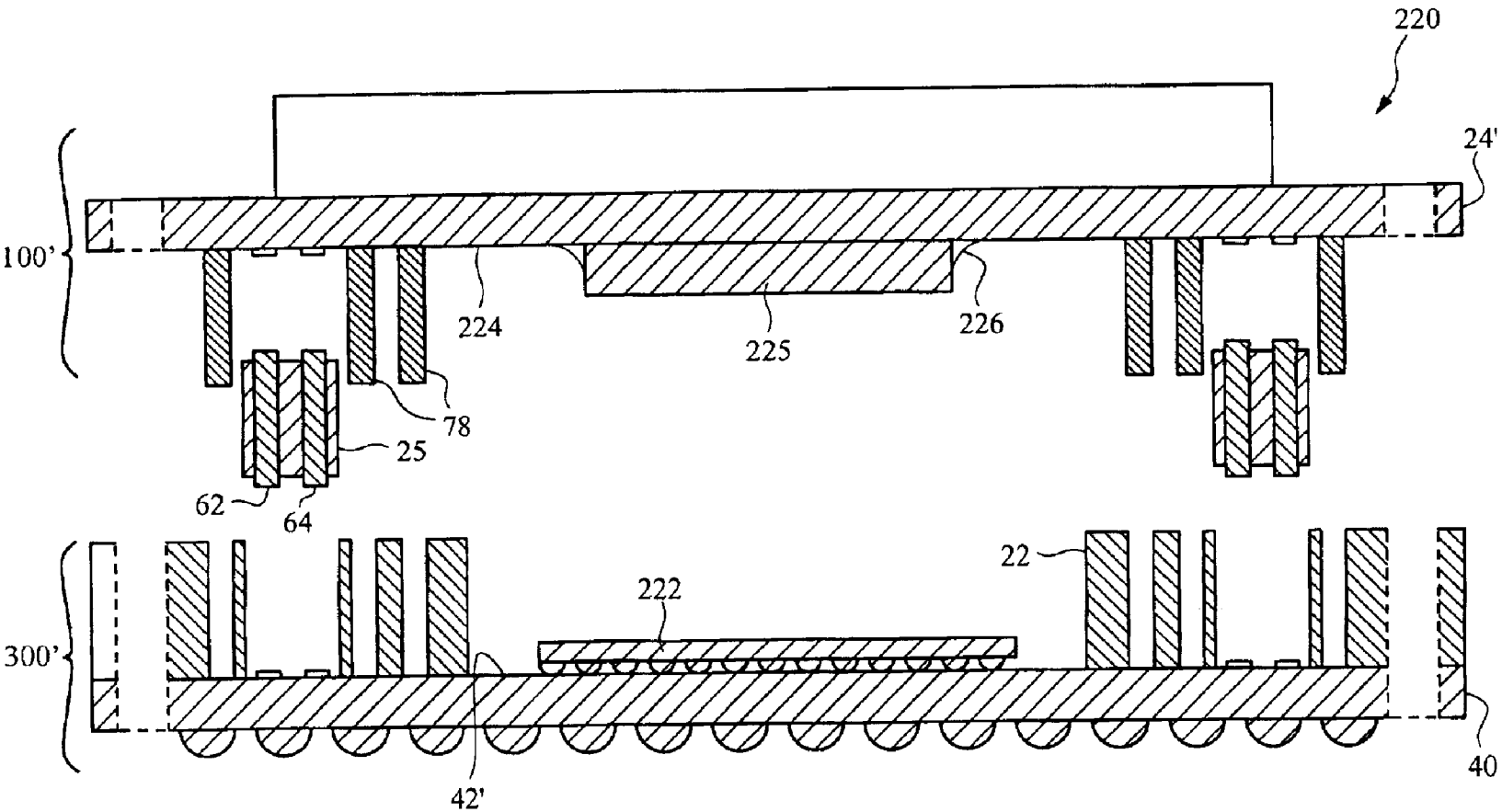
FIG. 11 is an exploded sectional view of a multipurpose mezzanine integrated circuit interconnect in accordance with an embodiment of the present invention.

Further referencing FIG. 11, undersurface 224 of the carrier or substrate of the terminal mezzanine may be described as a ceiling. The surface of central region 42' of socket PCB 40 may be described as a floor to interconnect assembly 220. Accordingly, flip-chip 222 may be referenced as a "floor IC", and integrated circuit 225 as a "ceiling IC".

In a particular embodiment, floor IC 122 (or 222) may comprise, e.g., a central processing unit (CPU), a field programmable gate array (FPGA), or other IC product. Ceiling IC 225 may comprise a memory unit, such as a read-only memory (ROM), or random access memory (RAM, SRAM, DRAM, etc.), or other complimentary IC product.

It may be understood that an FPGA is a device which may be modified after initial installation, i.e. "field programmable". In a further embodiment, the floor IC 222 comprises an FPGA and ceiling IC 225 may comprise a configuration ROM. Initial configuration processes may allow retrieval of data from the configuration ROM to configure the FPGA.

Similarly, in another example, floor IC 222 may comprise a central processing unit (CPU), and ceiling IC 225 may comprise a CPU memory unit, or vice versa. The mezzanine IC interconnects of the present invention may establish low-frequency paths with PGA conductors 78 and short high-frequency channels with MPI conductors 62,64 between the devices.

Figure 12:
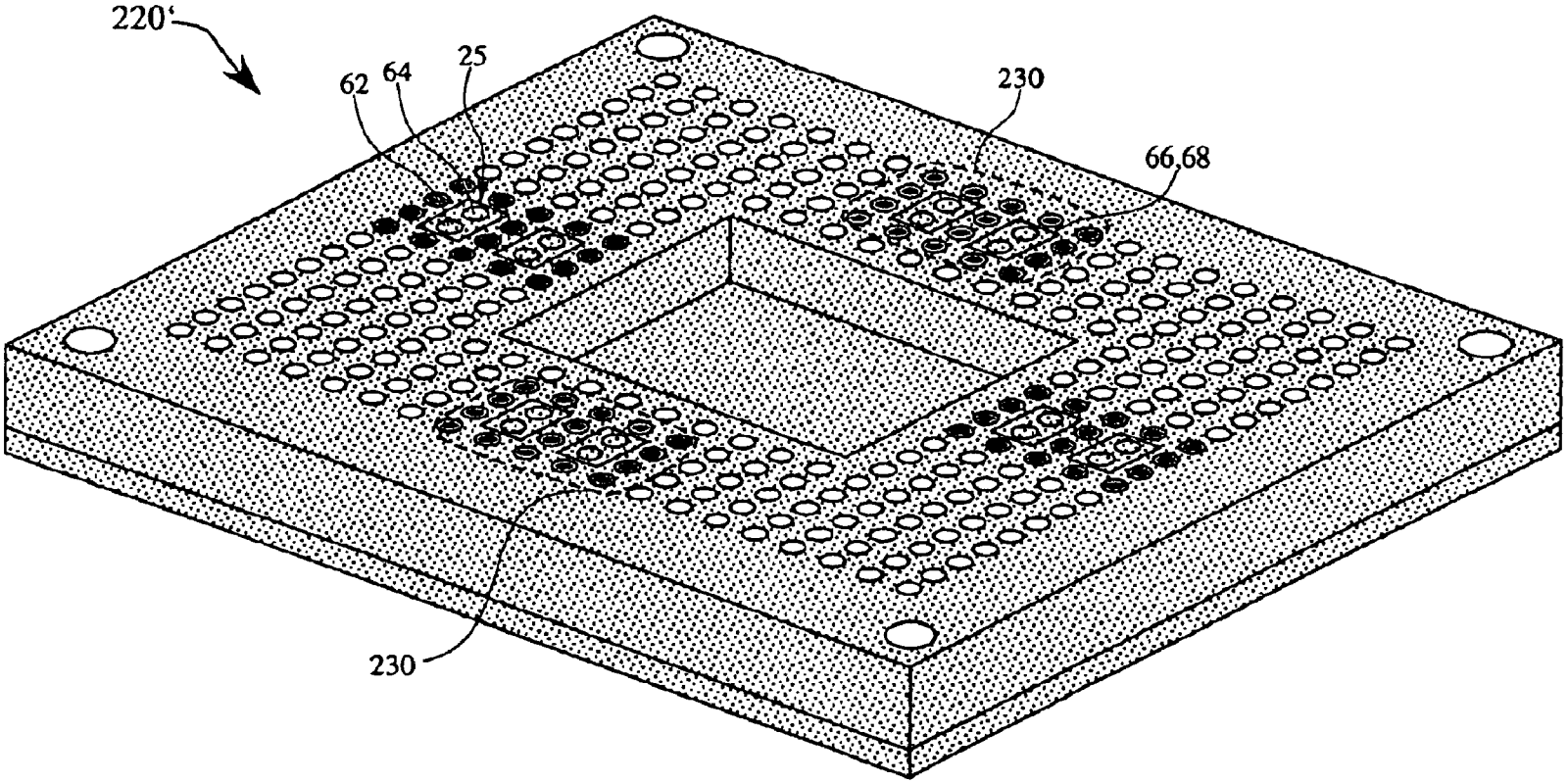
FIG. 12 is a perspective view of base mezzanine interconnect package showing ground conductors about the compressible columnar interconnects in accordance with another embodiment of the present invention.
Figure 13:
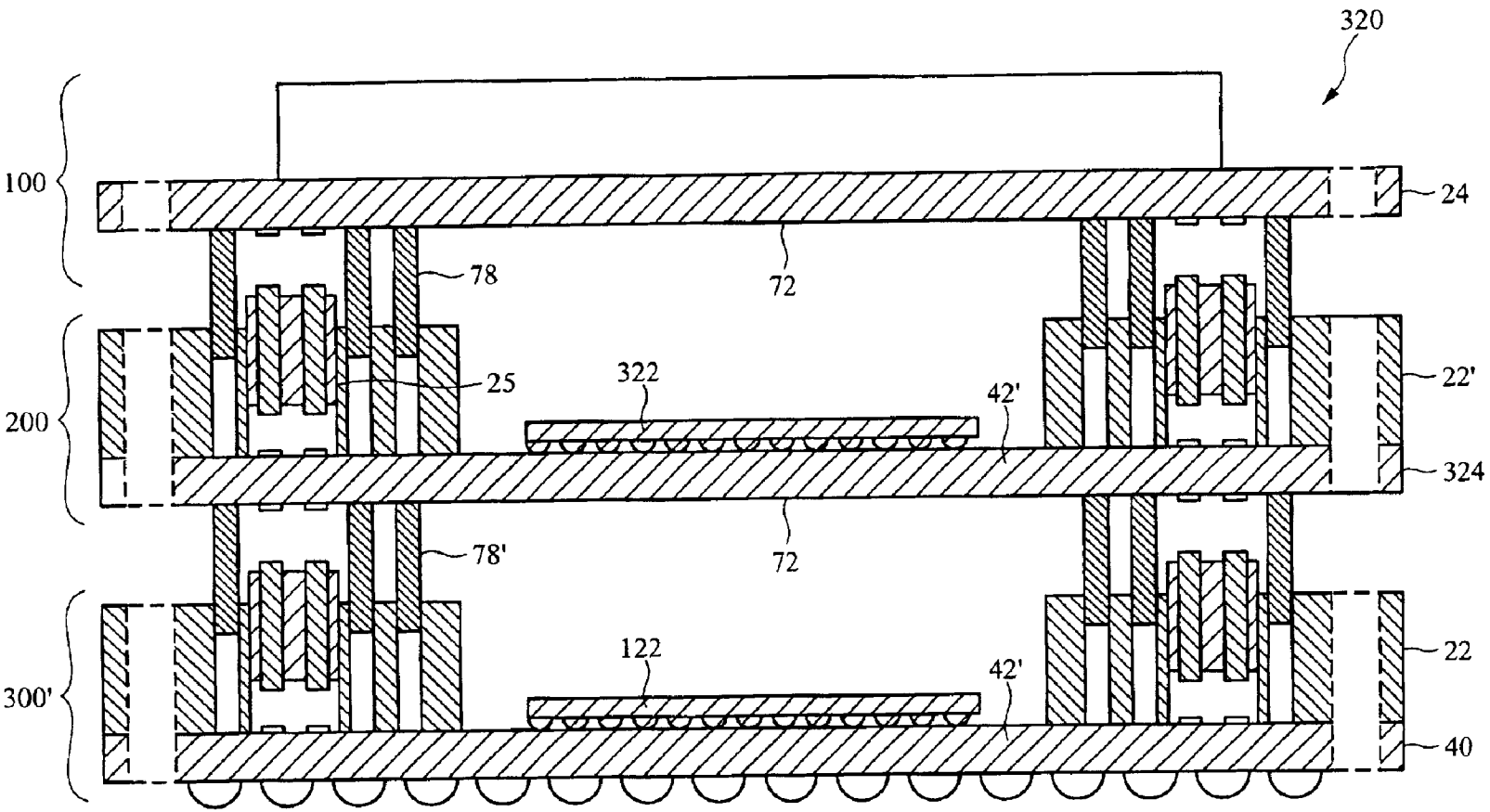
FIG. 13 is an exploded section view of a multi-layered mezzanine interconnect assembly in accordance with another embodiment of the present invention.

Referencing FIG. 12, another embodiment of the present invention may comprise socket package 220' with a group of grounded sockets 230 surrounding each pair of signal plugs 25. These grounded sockets may provide additional EMI/RFI shielding for high frequency signals that may be propagating along MPI conductors 62,64.

While the mezzanine IC interconnect packages 20,122, and 220 may be described herein as complete units, it is apparent that one manufacturer may produce the signal plug 25, another may produce the socket package 22, 22', 22' with or without the signal plugs 25 installed therein, and yet another manufacturer may produce the mezzanine package 24.

Further referencing FIGS. 1–2, while the illustrated embodiments may have disclosed terminal mezzanine package 100 with an IC plug-in structure 80 for enabling insertion and replacement flexibility; alternative implementations may directly attach IC product 28 to traces 75 of upper surface 74 of mezzanine carrier substrate 70. Additionally, mezzanine package 24 may carry other electronic devices directly attached to traces 75 and also may carry an alternative interposer structure for interchangeably receiving a selectable electronic component.

Some implementations may call for electrically isolated power leads when routing from base mezzanine package 300 to terminal mezzanine 100. For example, Micro Electro Mechanical Systems (MEMS) coupled to the terminal mezzanine 100 may need to be driven with high voltage (e.g. 100V) signals in isolation from other system signals. The surrounding ground conductors of the pins/sockets may thus assist shielding and/or isolation of the high-voltage signal lines.

Further referencing FIGS. 8–12, the multipurpose interconnect assemblies 120 and 220, which incorporate integrated circuits 122,222,225, may provide an integrated circuit package with an expansion socket on top to allow configuration modularity. Furthermore, many applications may call for tight, high-speed and reliably effective integration of two or more integrated circuits into a functional subsystem, which may be accomplished by mezzanine interconnect assemblies 120 and 220.

The flexibility of the mezzanine integrated circuit interconnects or interconnect assemblies 20, 120 and 220 may allow different PGA conductors 78 to conduct different power supply voltages from the electronic device PCB 26 to IC products 28, as well as to conduct these signals to floor and ceiling IC's 222,225 therein. Further, the configuration flexibility may assist initial design and prototyping, or aid designs that seek flexibility for enabling future upgrades or quick and economical repair; yet, at the same time, be able to establish effective and reliable high-speed interconnects between the various devices.

Moreover, assemblies 20, 120 and 220 of the various embodiments have the convenience and economies of PGA technology (e.g. alignment and clamping mechanical considerations, along with all non-multi-gigabit transceiver based I/O capabilities for power, ground and low frequency signals) combined with ultra-high speed multi-gigabit capabilities of LGA technology. Thus, the high-speed signaling benefits of MPI based LGA technology may be realized by systems 20,120 and 220, while managing the clamp pressure requirements and reducing mechanical and structural packaging challenges that might otherwise be encountered in typical LGA based systems.

For a differential pair transmission line structure, one conductor of the pair may carry a positive data signal and the other may carry the complement thereto. As a differential pair, they may assist preservation of signal integrity and may achieve isolation from external noise.

Further, the characteristic impedance of a differential pair may be designed to allow signal communication transfers (e.g., of tens of gigabits per second) along the differential pair with nominal reflections. The columnar MPI structures may be disposed relative to each other within the plug so as to preserve the transmission characteristic impedance and/or to match the associated characteristic impedances at, and through, the end launches of the columnar structures to respective substrates.

As the industry advances multi-gigabit communications (e.g., for wide area networks and fiber optic transmission), the mezzanine, interconnect assemblies 20,120 and 220 may support and assist the signal routing needs associated with these technologies. The exemplary embodiments of the present invention may accommodate these high-speed technologies for chip-to-chip and chip-to-card interconnects and associated signal communications through high-speed serial data links.

In the drawings and specification, there have been disclosed typical embodiments of this invention and, although specific terms are employed, they may be used in a generic and descriptive sense only and not for purposes of limitation. Additionally, it will be apparent to those skilled in this art that the particular embodiments illustrated or described herein are exemplary and that various changes and modifications may be made thereto as become apparent upon reading the present disclosure. Accordingly, such changes and modifications shall be deemed to fall within the scope of the appended claims.

What is claimed is:

1. An interconnect assembly to electrically couple an integrated circuit to an electronic device, comprising:

a first connector package to couple to the electronic device;

a second connector package disposed over the first connector package to receive the integrated circuit;

an array of first conductors comprising a first material disposed between the first connector package and the second connector package to carry low-frequency signals therebetween; and second conductors of a second material different from the first material, the second conductors disposed between the first connector package and the second connector package to carry high-frequency signals therebetween;

wherein the first conductors comprise:

metal lined sockets defined at least in part by sidewalls of the first connector package; and conductive pins seated in the sockets, the pins being supported by the second connector package; and the second conductors comprise:

columns of compressible conductive material as the second material;

the columns being compressed between the first and second connector packages.

2. The interconnect assembly of claim 1, wherein the second connector package is detachably attached to the first connector package.

3. The interconnect assembly of claim 1, wherein the compressible material comprises an elastic polymer compound embedded with metallized particles.

4. The interconnect assembly of claim 3, wherein:

the second material comprises a first resistivity in a relaxed state, and a second resistivity lower than the first resistivity in a compressed state; and the second conductors are mechanically biased in a compressed state.

5. The interconnect assembly of claim 3, further comprising:

at least one plug comprising insulating material; and at least one column of the columns of compressible material supported within the plug by the insulating material;

the first connector package further comprising walls defining a receptacle;

the plug disposed within the receptacle to position the at least one column coaxially therein; and the ends of the column contacting the respective first and second connector packages.

6. The interconnect assembly of claim 5, the plug supporting two columns of the compressible material to position the two columns as a pair substantially coaxially within the receptacle.

7. The interconnect assembly of claim 6, the pair of columns establishing a characteristic impedance therebetween; and the characteristic impedance of the pair to match characteristic impedances to and through respective launches of the ends of the columns to the first and second connector packages.

8. The interconnect assembly of claim 7, wherein:

the sockets and the pins socketed therein define an array of the first conductors between the first and second packages;

the plug with the pair of columns disposed in the receptacle amongst the array; and the pair of columns in substantially parallel relationship relative to the pins and sockets.

9. The interconnect assembly of claim 1, further comprising:

a first integrated circuit coupled to the second package as the integrated circuit; and at least one second integrated circuit connected to the second connector package.

10. The interconnect assembly of claim 9, at least one of the first and the second integrated circuits to communicate via the first and second conductors with the electronic device.

11. The interconnect assembly of claim 1, wherein the integrated circuit comprises a first integrated circuit, the interconnect further comprising:

a third integrated circuit supported by the first connector package;

the third integrated circuit in electrical communication with the first integrated circuit.

12. The interconnect assembly of claim 11, further comprising:

a second integrated circuit coupled to the second package;

the second integrated circuit in electrical communication with at least one of the third integrated circuit and the electronic device.

13. The interconnect assembly of claim 1, in which at least one column of the columns of compressible material is supported in insulated relationship within a receptacle of the first connector package.

14. The interconnect assembly of claim 13, in which the at least one column of compressible conductive material is supported within the receptacle by insulating material, the insulating material with the at least one column of compressible material defining at least in part a plug seated within the receptacle.

15. The interconnect assembly of claim 14, in which the plug is seated within the receptacle to position the at least one column of compressible conductive material in substantially coaxial relationship relative to sidewalls of the first connector package defining the receptacle.

16. An interconnect assembly to electrically couple an integrated circuit to an electronic device, comprising:

a first connector package to couple to the electronic device;

a second connector package disposed over the first connector package to receive the integrated circuit;

an array of first conductors comprising a first material disposed between the first connector package and the second connector package to carry low-frequency signals therebetween; and second conductors of a second material different from the first material, the second conductors disposed between the first connector package and the second connector package to carry high-frequency signals therebetween;

wherein:

the first connector package defines a plurality of sockets;

the second connector package comprises pins of a pin grid array (PGA) to mate with and detachably attach to sockets of the plurality;

the first material comprises metal defining the pins of the pin grid array;

the first connector package further defining receptacles dispersed amongst the plurality of sockets;

the second electrical conductors of the second material supported within respective receptacles of the first connector package; and the second material comprises a polymer compound embedded with metallized particles.

17. A method of interfacing an integrated circuit and an electronic device, comprising:

configuring low-frequency conductors between a base mezzanine package coupled to the electronic device and a terminal mezzanine package coupled to the integrated circuit, the low-frequency conductors to propagate low-frequency signals therebetween;

configuring high-frequency conductors of material different than the low-frequency conductors between the base mezzanine package and the terminal mezzanine package, the high-frequency conductors to propagate high-frequency signals therebetween; and interspersing the high frequency conductors amongst the low-frequency conductors.

18. The method of claim 17, further comprising:

using polymer compound with embedded metallized particles for the second material;

supporting columns of the polymer compound between the first and second connector packages; and compressing the columns into a conductive state.

19. The method of claim 18, further comprising:

mechanically securing the terminal mezzanine package to the base mezzanine package; and biasing the columns of the polymer compound in compression to establish the conductive state.

20. The method of claim 17, further comprising supporting the high-frequency conductors between sidewalls of a receptacle defined by the base mezzanine package.

21. The method of claim 17, further comprising:

supporting a second integrated circuit with the base mezzanine package; and electrically coupling terminals of the second integrated circuit to at least one conductor of the group consisting of the low-frequency and the high-frequency conductors to enable electrical communication with the integrated circuit supported by the terminal mezzanine package.

22. The method of claim 21, further comprising:

transmitting at least one signal between the second integrated circuit and the first integrated circuit; and transmitting at least one signal between the second integrated circuit and the electronic device.

23. The method of claim 21, further comprising:

supporting a third integrated circuit with the terminal mezzanine package; and electrically coupling terminals of the third integrated circuit to at least one conductor of the group consisting of the low-frequency and the high-frequency conductors to enable electrical communication with the second integrated circuit.

24. The method of claim 23, further comprising:

propagating at least one signal between the second integrated circuit and the first integrated circuit;

propagating at least one signal between the second integrated circuit and the electronic device; and propagating at least one signal between the third integrated circuit and the second integrated circuit.

25. The method of claim 23, wherein:

one of the second integrated circuit and the third integrated circuit comprises a memory device; and the other of the second integrated circuit and the third integrated circuit comprises a processor; and the method further comprises electrically coupling data terminals of the memory device and the processor using the high-frequency conductors.

26. The method of claim 23, further comprising:

using a memory unit as one of the second integrated circuit and third integrated circuit;

using a field programmable gate array (FPGA) as the other of the second integrated circuit and the third integrated circuit; and using the high-frequency conductors to configure communication channels between the memory unit and the FPGA.

27. A connector package to interface a mezzanine package to a circuit board comprising:

a base carrier comprising:

a plurality of PGA contacts, a plurality of LGA contacts, and conductors coupled to the PGA and the LGA contacts, and to electrically communicate with the circuit board;

a body unit on the base carrier;

the body unit to align PGA conductors of the mezzanine package with respective PGA contacts;

the body unit defining an opening to access at least one LGA contact of the plurality; and at least one support body supporting at least one compressible electrical interconnect, the support body seated in the opening to place the compressible electrical interconnect in contact with an LGA contact of the base carrier.

28. The package of claim 27, wherein the compressible electrical interconnect comprises:

polymer compound; and metallized particles suspended in the polymer compound;

the polymer compound compressible and in contact with the LGA contact.

29. The package of claim 28, wherein the polymer compound with metallized particle is compressible for electrical conductivity when the mezzanine package is mated to the body unit.

30. The package of claim 28, wherein:

the opening is defined at least in part by sidewalls of the body unit that establish a perimeter for a receptacle opening;

the support body comprises a perimeter less than the perimeter of the receptacle opening; and the package further comprises material flexibly securing the support body within the receptacle.

31. The package of claim 27, further comprising a mechanical clamping mechanism operable to secure the mezzanine package to the body unit and base carrier.

32. The package of claim 27, the body unit comprising a plurality of sockets; and the sockets sized to receive respective pins of the PGA conductors of the mezzanine package.

33. The package of claim 32, the plurality of sockets defining an array within the body unit to mate respective pins of a pin grid array (PGA) of the mezzanine package.

34. The package of claim 33, wherein:

the walls of the body unit define the openings to be in dispersed relationship amongst the plurality of sockets; and the support body of the at least one, to position the electrical interconnect in substantially parallel relationship to the sockets.

35. The package of claim 27, the base carrier further comprising:

surface mount pads on a surface thereof opposite the LGA and PGA pads; and conductors electrically coupling the PGA and LGA contacts to the surface mount pads.

36. The package of claim 27, the support body further comprising a layer of conductive material against the sidewalls and coaxial about the interconnect.

37. The package of claim 36, the body unit further comprising conductive material lining sidewalls of the receptacles.

38. The package of claim 37, further comprising electrically conductive bonding agent securing the support body within the receptacle.

39. The package of claim 27, wherein:

the body unit comprises a plurality of sockets sized to receive pins of the mezzanine package; and sockets of the plurality that neighbor the receptacle electrically coupled in common and to electrically shield the interconnect of the support body.

40. The package of claim 27, wherein:

the base carrier comprises a central portion, the PGA and LGA contacts around a periphery of the central portion;

the body unit further comprising walls defining a window to enable access to the central portion of the base carrier;

the package further comprises:

a second integrated circuit coupled to the base carrier within the central portion; and conductors supported by the central portion of the base carrier to electrically couple terminals of the second integrated circuit to at least one of the PGA and LGA contacts.

41. An intermediate connector package to be disposed between a first connector package and a terminal connector package to electrically couple an integrated circuit carried by the terminal connector package to an electronic device that carries the first connector package, comprising:

a base having opposing first and second surfaces;

an array of pin/sockets supported by the first surface of the base to mate with respective socket/pins of the first connector package;

a plurality of land-grid (LGA) pads supported by the first surface of the base to electrically interface high-frequency signals for the first connector package;

a plurality of receptacles defined at least in part by walls of the base and about respective LGA pads, the LGA pads defining in part a floor to the associated receptacles of the plurality;

columns of compressible conductive material supported by a second surface of the base to carry high-frequency signals to the terminal connector package; and an array of socket/pins supported by the second surface of the base to mate with respective pin/sockets of the terminal connector package.

42. The intermediate connector package of claim 41, further comprising:

an intermediate integrated circuit supported by the base;

the intermediate integrated circuit in electrical communication with at least one of the pin/sockets, the columns of compressible conductive material, LGA pads, and the socket/pins.

43. The intermediate connector package of claim 42, wherein the intermediate integrated circuit is supported by the second surface of the base.

44. The intermediate connector package of claim 42, wherein the columns of compressible conductive material comprise compressible polymer with embedded metallized particles to electrically conduct when biased in compression between the base and the terminal connector package.

45. A terminal mezzanine package to electrically couple an integrated circuit to another connector package for electrical communication with an electronic device, comprising:

a base having opposing first and second surfaces;

an array of pins (PGA) supported by the first surface of the base, the pins to mate with respective sockets of the another connector package;

a plurality of Land-Grid-Array (LGA) pads at the first surface of the base dispersed amongst the pins of the PGA;

a plurality of compressible columns with embedded metallized particles (MPI) to electrically couple to respective pads of the LGA when biased in compression and assembled with the another connector package; and a coupling mechanism supported by the second surface of the base to receive terminals of the integrated circuit and electrically couple the terminals to at least one of the first and second conductors.

46. The terminal mezzanine package of claim 45, wherein the integrated circuit comprises a first integrated circuit, further comprising:

a second integrated circuit supported by the base;

the second integrated circuit in electrical communication with at least one of the pins, the LGA pads, and the first integrated circuit.

47. The intermediate connector package of claim 46, wherein the second integrated circuit is supported by the first surface of the base.

48. The intermediate connector package of claim 46, wherein the compressible columns comprise a first resistivity in a relaxed state, and a second resistivity lower than the first resistivity in a compressed state achieved when operationally assembled with the another connector package.

49. The terminal mezzanine package of claim 45, wherein the coupling mechanism comprises an integrated circuit socket having receptacles that detachably receive the terminals of the integrated circuit.

50. A system comprising:

a plurality of integrated circuit devices (ICs); and an interconnect for interconnecting the ICs, comprising:

a support structure having low frequency openings receiving pins for carrying low frequency signals between two of the ICs and high frequency openings for carrying high frequency signals between the two of the ICs, and a set of plugs inserted into the high frequency openings, each plug of the set of plugs supporting at least one column of conductive elastomeric material, wherein the at least one column of conductive elastomeric material is operable between its first and second ends to enable high frequency signal propagation between the two of the ICs;

a base carrier comprising:

a lower surface comprising contacts to electrically interface a circuit board, an upper surface opposite the lower surface, the pins comprising a first portion projecting from the upper surface into associated ones of the low-frequency openings, and at least one conductive pad on the upper surface contacting a first end of the at least one column of the conductive elastomeric material in the associated high frequency openings;

a terminal mezzanine comprising:

first and second opposite surfaces, the pins having a second portion on the first surface electrically coupled to the first portions of the pins in the associated low-frequency openings, and a conductive pad on the first surface contacting a second end of the column of elastomeric conductive material of the associated high frequency openings; and at least one of the plurality of integrated circuit devices supported by the terminal mezzanine and at least another of the plurality of integrated circuit devices supported by the base carrier.

51. The system of claim 50, wherein the at least one column comprises two columns to propagate a differential signal.

52. The system of claim 50, in which the terminal mezzanine supports a plurality of the conductive pins to define at least part of a pin grid array;

the conductive pad of the terminal mezzanine defines part of a land-grid-array (LGA) contact disposed per a planar view amongst the array of pins; and the pins of the plurality extend through respective ones of the low-frequency openings and further align, relative thereto, the LGA contact in a lateral placement for contacting the second end of the column of elastomeric conductive material.

53. The system of claim 52, in which the pins of the PGA that extend from the terminal mezzanine mate securely with the respective ones of the low-frequency openings; and the openings secure the pins with sufficient retention to enable longitudinal compressive contact of the second end of the column of elastomeric conductive material against the LGA pad.

54. A chip-scale mezzanine package, comprising:

a connector base to couple to an electronic device;

a mezzanine carrier disposed over the connector base;

a chip coupled to the mezzanine carrier;

an array of first conductors of first material coupled between the connector base and the mezzanine carrier to propagate low-frequency signals therebetween; and second conductors of a second material different from the first material, disposed between the connector base and the mezzanine carrier to propagate high-frequency signals therebetween wherein:

the chip comprises a flip-chip mounted to a surface of the mezzanine carrier facing the connector base;

the array of first conductors comprise pins/sockets and sockets/pins extending from the mezzanine carrier and the connector base respectively, the pins thereof mated within associated sockets; and the pins and the sockets of the array extending between regions of the mezzanine carrier and the connector base laterally outside a perimeter of the mounted flip-chip.

55. The chip-scale mezzanine package of claim 54, wherein:

the second conductors comprise at least one column of compressible conductive material; and the at least one column of compressible conductive material being mechanically biased in compression between the connector base and the mezzanine carrier.

56. The chip-scale mezzanine package of claim 55, further comprising:

insulating material supporting the column of compressible conductive material as a plug;

the connector base comprising sidewalls defining a receptacle; and the plug being seated within the receptacle to position the at least one column of compressible conductive material in substantially coaxial relationship relative to the sidewalls defining the receptacle.

57. The chip-scale mezzanine package of claim 56, wherein:

the at least one column of compressible conductive material comprises two columns of the compressible conductive material operable within the plug to enable propagation of signals along their length with a given characteristic impedance;

the connector base comprising a pair of land-grid-array (LGA) pads contacting first ends of the two columns of the compressible conductive material; and the mezzanine carrier comprising a pair of land-grid-array (LGA) pads contacting second ends of the two columns of the compressible material, the second ends opposite the respective first ends via the columnar lengths of the columns.

58. The chip-scale mezzanine package of claim 57, further comprising:

metallization lining the sidewalls defining the receptacle;

wherein the plug supports the two columns of the compressive conductive material as a pair for the substantially coaxial relationship relative to the sidewalls with the metallized lining that define the receptacle.

59. The chip-scale mezzanine package of claim 54, wherein the pins are mated with the associated sockets with mechanical retention forces sufficient to mechanically bias the at least one column of the compressible conductive material in compression between the connector base and the mezzanine carrier.

60. The chip-scale mezzanine package of claim 59, wherein:

the connector base comprises at least one land-grid-array (LGA) pad contacting a first end of the at least one column of the compressible conductive material;

the mezzanine carrier comprises at least one LGA pad contacting a second end of the at least one column of the compressible conductive material, the second end opposite to the first via the column's columnar length; and the at least one column of the compressible conductive material compressed between the LGA pad of the connector base and the LGA pad of the mezzanine carrier.

61. An interconnect to couple an integrated circuit to a circuit board, comprising:

a support structure comprising:

a first set of openings associated with signals of low frequency, the first set of openings defining an array of apertures to receive at least a portion of a pin grid array, and a second set of openings associated with signals of high frequency, the second set of openings disposed amongst the array defined by the first set of openings; and plugs comprising:

insulating material seated within the second set of openings, and at least one column of elastomeric conductive material supported by the insulating material within at least one of the second set of openings;

wherein the at least one column of elastomeric conductive material within the second set of openings defines at least part of a transmission path for high frequency signals between the circuit board and the integrated circuit.

* * * * *